US009211743B2

(12) United States Patent
Izuo

(10) Patent No.: US 9,211,743 B2
(45) Date of Patent: Dec. 15, 2015

(54) DROPLET DISCHARGE DEVICE AND DROPLET DISCHARGE METHOD

(71) Applicant: SEIKO EPSON CORPORATION, Tokyo (JP)

(72) Inventor: Seiji Izuo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,836

(22) Filed: Sep. 15, 2014

(65) Prior Publication Data

US 2015/0116394 A1 Apr. 30, 2015

(30) Foreign Application Priority Data

Oct. 24, 2013 (JP) ..... 2013-221645

(51) Int. Cl.

| | |
|---|---|
| ***B41J 25/308*** | (2006.01) |
| ***B41J 11/20*** | (2006.01) |
| ***B41J 2/045*** | (2006.01) |
| ***B41J 2/21*** | (2006.01) |
| ***B41J 2/13*** | (2006.01) |
| *B41J 29/393* | (2006.01) |

(52) U.S. Cl.

CPC ..... *B41J 25/3086* (2013.01); *B41J 2/04505* (2013.01); *B41J 2/13* (2013.01); *B41J 2/2132* (2013.01); *B41J 2/2135* (2013.01); *B41J 11/20* (2013.01); *B41J 25/308* (2013.01); *B41J 2029/3935* (2013.01)

(58) Field of Classification Search

CPC ..... B41J 11/20; B41J 25/308; B41J 2/04505; B41J 2/2132; B41J 2/2135; B41J 2/13; B41J 2029/3935

See application file for complete search history.

(56) References Cited

U.S. PATENT DOCUMENTS

| | | | | |
|---|---|---|---|---|
| 6,960,036 | B1 | 11/2005 | Fujita et al. | |
| 7,530,660 | B2 | 5/2009 | Yamanobe | |
| 2007/0024663 | A1 * | 2/2007 | Yamanobe | 347/19 |
| 2011/0249062 | A1 | 10/2011 | Nakano et al. | |

FOREIGN PATENT DOCUMENTS

| | | |
|---|---|---|
| JP | 2007-030363 | 2/2007 |
| JP | 2010-241148 | 10/2010 |
| JP | 2011-218624 | 11/2011 |

* cited by examiner

*Primary Examiner* — Julian Huffman
(74) *Attorney, Agent, or Firm* — Workman Nydegger

(57) ABSTRACT

A printer includes a control section that is capable of executing a first process for forming an image on a sheet by discharging ink droplets from a liquid ejection head on the basis of image data and a second process for forming, on the sheet, a test pattern for determination of a shift in ink droplet adhesion position by discharging droplets on the basis of test data. The control section executes the second process in a state in which a print gap between the liquid ejection head and a support is longer than the shortest adjustable print gap.

5 Claims, 14 Drawing Sheets

DROPLET DISCHARGE DEVICE AND DROPLET DISCHARGE METHOD

BACKGROUND

1. Technical Field

The present invention relates to a droplet discharge device and a droplet discharge method for discharging liquid in the form of droplets.

2. Related Art

Conventionally, ink jet printers are known as one kind of droplet discharge device. Ink jet printers perform printing by causing ink (liquid) to be ejected in the form of ink droplets (droplets) from a liquid ejection head (an ejecting section) toward a sheet (a medium) and to be adhered onto the sheet (see, for example, JP-A-2007-30363). It is also known that, in such printers, a shift in ink droplet adhesion position on a sheet occurs, for example, in a case where a liquid ejection head is mounted in the printer in an inclined state from a proper posture.

Such a shift in ink droplet adhesion position may undesirably cause a decrease in printing accuracy such as color irregularities in a printed image on a sheet. Conventionally, such a shift in ink droplet adhesion position is checked as follows. Specifically, a linear test pattern is formed on a sheet by causing a plurality of nozzles (discharge openings) that constitute a nozzle array of a liquid ejection head to discharge ink droplets onto the sheet while moving the liquid ejection head and the sheet relative to each other, and the actual degree of such a shift in ink droplet adhesion position is checked on the basis of the test pattern thus formed. In a case where it is determined that a shift in ink droplet adhesion position has occurred, the shift in ink droplet adhesion position is corrected through an adjusting operation such as correction of inclination of the liquid ejection head.

A shift in ink droplet adhesion position is judged by comparing (i) an ideal supposed pattern that is supposed to be formed on a sheet in a case where a liquid ejection head is correctly mounted at a proper position without inclination and (ii) a test pattern that is actually formed on a sheet by discharge of ink droplets. However, this method has a problem that in a case where the degree of the shift in ink droplet adhesion position is very small, it is difficult to judge such a very small shift.

This problem is common to not only ink jet printers but also droplet discharge devices in general which discharge liquid in the form of droplets.

SUMMARY

An advantage of some aspects of the invention is that a droplet discharge device and a droplet discharge method that make it possible to easily determine whether a droplet adhesion position is shifted or not, even in a case where the degree of the shift is very small are provided.

The following describes means for solving the above problems and the effects.

A droplet discharge device includes: a discharging section having a discharge opening that is capable of discharging liquid in the form of droplets; a supporting member that is capable of supporting a medium onto which the droplets discharged from the discharge opening adhere; a gap adjusting section that is capable of adjusting a print gap between the discharging section and the supporting member; and a control section that is capable of executing a first process for forming an image on the medium by discharging droplets from the discharging section on the basis of image data and a second process for forming, on the medium, a test pattern for determination of a shift in droplet adhesion position by discharging droplets on the basis of test data, the control section executing the second process in a state in which the print gap is longer than the shortest print gap adjustable by the gap adjusting section.

According to the arrangement, in a case where the second process is executed, the print gap between the discharging section and the supporting member is adjusted to a print gap longer than the shortest print gap adjustable by the gap adjusting section. An amount of shift in droplet adhesion position that occurs because of inclination of a droplet discharging direction from a normal direction becomes larger depending on the distance of movement of the droplets. Accordingly, as the distance of movement of the droplets becomes larger, the amount of shift in droplet adhesion position becomes larger. That is, the state of shift in droplet adhesion position in the test pattern formed on the medium is exaggerated. It is therefore possible to easily determine whether adhesion positions of droplets are shifted or not, even in a case where the degree of the shift in droplet adhesion position is very small.

The droplet discharge device is preferably arranged such that the control section executes the second process in a state in which the print gap is longer than that in the first process.

According to the arrangement, also in a case where after execution of the first process for forming an image on a medium, the second process for forming a test pattern on the same medium is executed, the print gap between the discharging section and the supporting member becomes longer. This exaggerates the state of shift in droplet adhesion position in the test pattern. It is therefore possible to easily determine whether adhesion positions of droplets are shifted or not, even in a case where the degree of the shift in droplet adhesion position is very small.

The droplet discharge device is preferably arranged such that the gap adjusting section adjusts the print gap by moving the discharging section in a direction away from the supporting member.

According to the arrangement, a space occupied for the movement is smaller than that in a case where the supporting member is moved in a direction away from the discharging section. This contributes to a reduction in the size of the whole device.

The droplet discharge device is preferably arranged such that the control section causes the medium and the discharging section to move relative to each other in the first process and the second process; and the control section causes the speed of the relative movement between the medium and the discharging section in the second process to be higher than that in the first process.

According to the arrangement, in a case where the second process is executed, in which droplets are discharged from the discharge opening of the discharging section that moves relative to the medium, the speed of relative movement between the medium and the discharging section becomes higher. Accordingly, in a case where a shift in droplet adhesion position on the medium has occurred, an amount of the shift in droplet adhesion position becomes larger. That is, the state of shift in droplet adhesion position in the test pattern formed on the medium is further exaggerated. It is therefore possible to more easily determine whether adhesion positions of droplets are shifted or not, even in a case where the degree of the shift in droplet adhesion position is very small.

The droplet discharge device is preferably arranged such that the control section causes the speed of discharge of the droplets from the discharge opening in the second process to be lower than that in the first process.

According to the arrangement, in a case where the second process is executed, in which droplets are discharged from the discharge opening of the discharging section that moves relative to the medium, the speed of discharge of droplets from the discharge opening becomes lower. Accordingly, in a case where a shift in droplet adhesion position on the medium has occurred, an amount of the shift in droplet adhesion position becomes larger. That is, the state of shift in droplet adhesion position in the test pattern formed on the medium is further exaggerated. It is therefore possible to more easily determine whether adhesion positions of droplets are shifted or not, even in a case where the degree of the shift in droplet adhesion position is very small.

A droplet discharge method executed in a droplet discharge device that includes a discharging section having a discharge opening that is capable of discharging liquid in the form of droplets and a supporting member that is capable of supporting a medium onto which the droplets discharged from the discharge opening adhere, a print gap between the discharging section and the supporting member being adjustable, the droplet discharge method comprising: executing a first process for forming an image on the medium by discharging droplets from the discharging section on the basis of image data; and executing a second process for forming, on the medium, a test pattern for determination of a shift in droplet adhesion position by discharging droplets on the basis of test data, the second process being executed in a state in which the print gap is longer than the shortest adjustable print gap.

According to the arrangement, it is possible to produce effects similar to those produced by the droplet discharge device.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

With reference to FIGS. 1 through 9, the following describes a first embodiment of an ink jet printer (one example of a droplet discharge device) that discharges ink (one example of liquid) in the form of ink droplets (one example of droplets) and a method for discharging ink droplets in this printer (an ink droplet discharge method).

Figure 1:
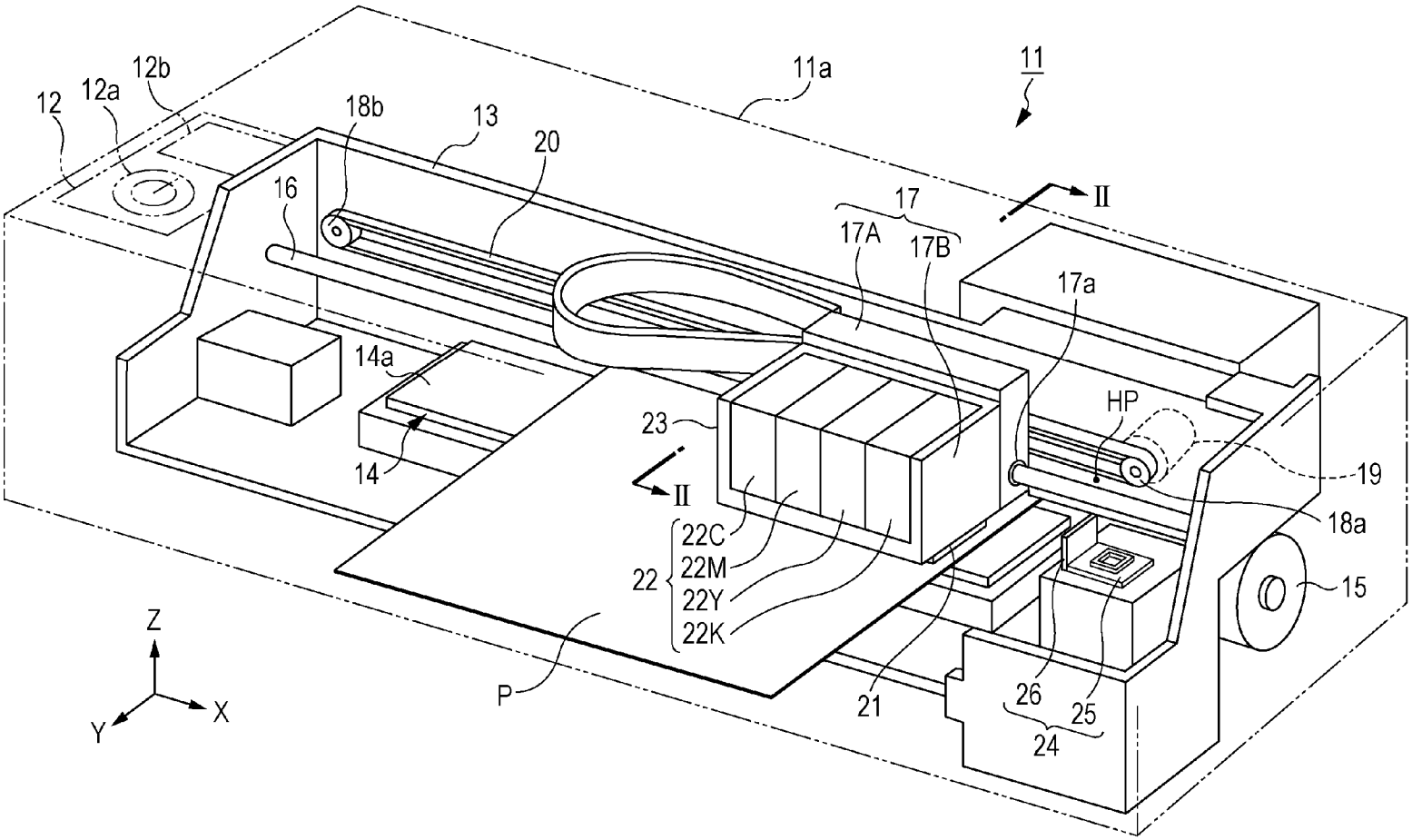
FIG. 1 is a perspective view of a serial type printer according to a first embodiment.

As shown in FIG. 1, a printer 11 according to the present embodiment includes a housing 11*a* (part of which is indicated by a two-dot chain line) having a substantially rectangular parallelepiped shape. On a surface of the housing 11*a* on the +Z direction side which is opposite to the gravity direction (the −Z direction) side, i.e., on a top surface of the housing 11*a*, an operation panel 12, which is a touch panel, is provided. A power button 12*a* and a display section 12*b* are provided on the operation panel 12. The power button 12*a* is touch-operated to turn on or off the printer 11. The display section 12*b* is, for example, a liquid crystal screen on which information on various kinds of processing performed in the printer 11 is displayed.

In the housing 11*a*, a frame 13 having a shape of a substantially rectangular box is contained. On a bottom part of the frame 13 which is on the gravity direction (−Z direction) side, a support (one example of a supporting member) 14 is provided so as to extend in a substantially horizontal direction. The longitudinal direction of the support 14 is the X direction that is orthogonal to the +Y direction (a transport direction in which a sheet P is transported). On the rear side of the frame 13, i.e., on the −Y direction side opposite to the +Y direction side which is the front side, a sheet feeding motor 15 is provided below the frame 13. A top surface of the support 14 is a supporting surface 14*a* that is capable of supporting the sheet P from the gravity direction (−Z direction) side. The sheet P is transported onto the supporting surface 14*a* from the rear side to the front side in accordance with driving of the sheet feeding motor 15.

Above the support 14, a guide shaft 16 is provided in the frame 13 so as to extend along the X direction, which is the longitudinal direction of the support 14. The guide shaft 16 supports a carriage 17 in a manner such that the carriage 17 is movable reciprocally along the shaft direction. Specifically, the carriage 17 has a main carriage 17A through which a supporting hole 17*a* is formed in the left-right direction, which is parallel with the X direction, and a sub-carriage 17B that is attached to a front side of the main carriage 17A so as to be movable in a top-bottom direction. In the supporting hole 17*a* of the main carriage 17A, the guide shaft 16 is inserted.

On an inner surface of a rear wall of the frame 13, a driving pulley 18*a* and a driven pulley 18*b* are rotatably supported in the vicinities of the opposite ends of the guide shaft 16. An output shaft of a carriage motor 19 is connected to the driving pulley 18*a*. An endless timing belt 20, part of which is connected to the carriage 17, is provided between the driving pulley 18*a* and the driven pulley 18*b* so as to be wound around the driving pulley 18*a* and the driven pulley 18*b*. Through driving of the carriage motor 19, the carriage 17 is moved reciprocally by the timing belt 20 in the left-right direction, which is the X direction, while being guided by the guide shaft 16.

On a lower part of the sub-carriage 17B of the carriage 17, a liquid ejection head (one example of a discharging section) 21 is provided. On an upper part of the sub-carriage 17B, a holder section 23 in which ink cartridges 22 containing ink are detachably provided is provided. In the holder section 23, a plurality of (four in the present embodiment) ink cartridges 22C, 22M, 22Y, and 22K containing ink of respective different colors (e.g., cyan, magenta, yellow, and black) are mounted.

The ink cartridges 22 (22C, 22M, 22Y, and 22K) supply ink to the liquid ejection head 21, and the ink thus supplied to the liquid ejection head 21 is discharged onto the sheet P from the liquid ejection head 21 moving reciprocally together with the carriage 17 in the scanning direction by driving of the carriage motor 19.

In a case where the ink is discharged on the basis of image data onto the sheet P in the form of ink droplets from the liquid ejection head 21, an image is printed on the sheet P. Meanwhile, in a case where the ink is discharged on the basis of test data, a test pattern for determination of shift in ink droplet adhesion position is printed on the sheet P.

It can therefore be said that the printer 11 according to the present embodiment is a so-called serial type printer (droplet discharge device) in which a liquid ejection head (discharging section) 21 discharges ink droplets (liquid) toward a sheet (medium) P while moving in a scanning direction orthogonal to a direction in which the sheet P is transported. Furthermore, in the present embodiment, the carriage motor 19 functions as a movement driving section that is driven so as to achieve relative movement between the sheet (medium) P and the liquid ejection head (discharging section) 21.

Returning to FIG. 1, a region that is on the right (the +X direction side) of the support 14 in the frame 13 in the left-right direction (the X direction) when viewed from the +Y direction (the transporting direction) side is a home position region HP which is not used during printing. In the home position region HP, a maintenance device 24 is provided. The maintenance device 24 has a cap 25 whose top is opened, a wiper 26 having a blade shape, etc. In the printer 11, after the carriage 17 is moved to the home position region HP, the maintenance device 24 performs a maintenance operation so that ink droplets can be stably discharged from the liquid ejection head 21.

Figure 2:
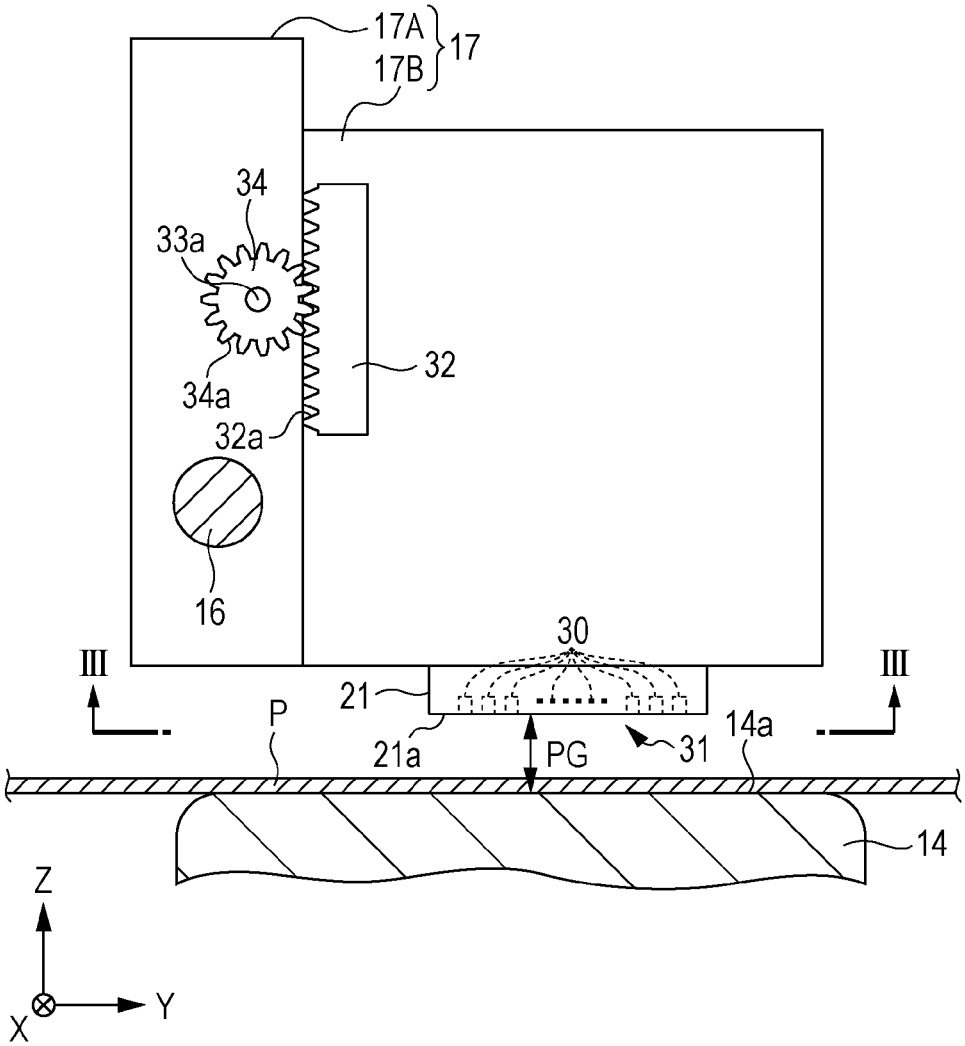
FIG. 2 is a cross-sectional view schematically showing a substantial part of the printer taken along the line II-II in FIG. 1.
Figure 3:
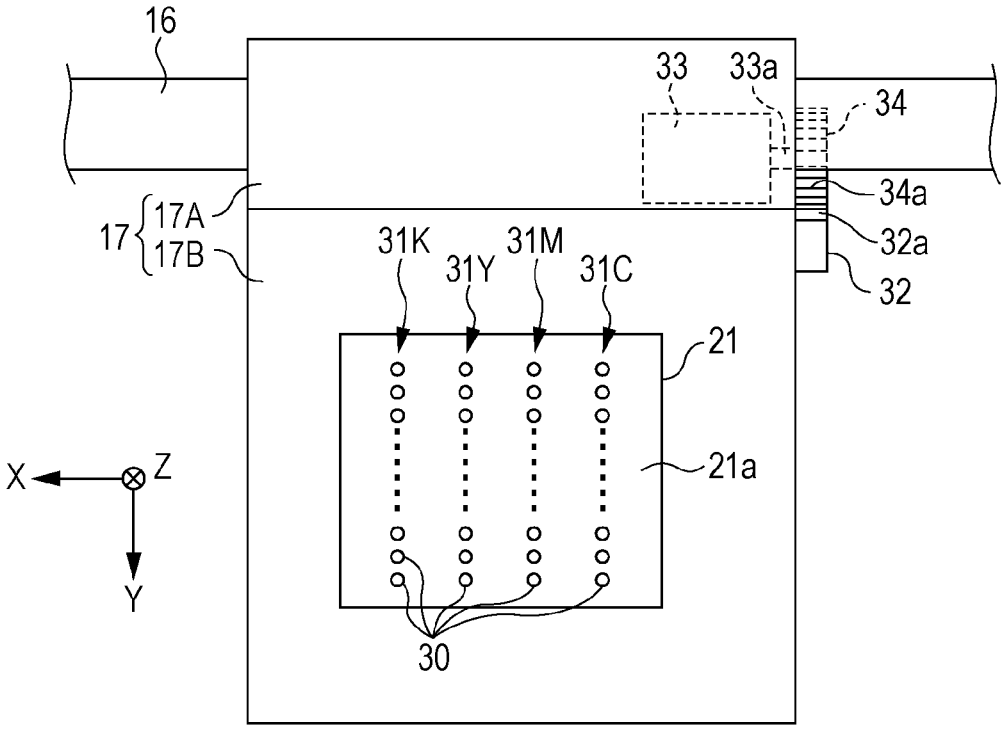
FIG. 3 is a fragmentary view taken along the line III-III in FIG. 2.

As shown in FIGS. 2 and 3, the liquid ejection head 21 has, on a nozzle formation surface 21*a*, a plurality of nozzles (one example of discharge openings) 30 from which ink can be discharged in the form of ink droplets. The nozzle formation surface 21*a* is a surface that faces the supporting surface 14*a* of the support 14 in the top-bottom direction during printing. In the present embodiment, ink droplets of four colors, i.e., cyan, magenta, yellow, and black can be discharged from the nozzles 30. On the nozzle formation surface 21*a* of the liquid ejection head 21, these nozzles 30 constitute a plurality of (four in the present embodiment) nozzle arrays 31 (31C, 31M, 31Y, and 31K) for the respective colors. The nozzle arrays 31 extend along the Y direction which is the transporting direction of the sheet P.

The sub-carriage 17B has a vertically long rack member 32 that is fixed to a surface on the −X direction side opposite to the home position region HP side, i.e., a left side surface so that a tooth section 32*a* formed on a long side of the rack member 32 runs along a back surface of the sub-carriage 17B, i.e., a boundary with a front surface of the main carriage 17A. Meanwhile, the main carriage 17A has a gap adjusting motor 33 therein. The gap adjusting motor 33 has an output shaft 33*a* that protrudes towards the −X direction side from a surface (i.e., a left side surface) of the main carriage 17A which is on the −X direction side opposite to the home position region HP. A pinion 34 is fixed to a tip of the output shaft 33*a*. The pinion 34 has a tooth section 34*a* that meshes with the tooth section 32*a* of the rack member 32 of the sub-carriage 17B.

That is, the sub-carriage 17B moves upward or downward together with the rack member 32 since the rack member 32 that meshes with the pinion 34 moves upward or downward in accordance with driving of the gap adjusting motor 33.

Accordingly, a print gap PG in the top-bottom direction between (i) the nozzle formation surface 21*a* on which the nozzles (discharge openings) 30 of the liquid ejection head (discharging section) 21 supported by the sub-carriage 17B and (ii) the supporting surface 14*a* of the support 14 on which the sheet P is supported is adjustable by driving of the gap adjusting motor 33. In this respect, in the present embodiment, the gap adjusting motor 33 functions as a gap adjusting section that is capable of adjusting the print gap PG between the nozzle formation surface 21*a* of the liquid ejection head 21 and the supporting surface 14*a* of the support 14. In other words, the gap adjusting section is capable of adjusting the print gap PG between the discharging section (the liquid ejection head 21) and the supporting member (the support 14).

Next, the following describes an electrical arrangement of the printer 11.

Figure 4:
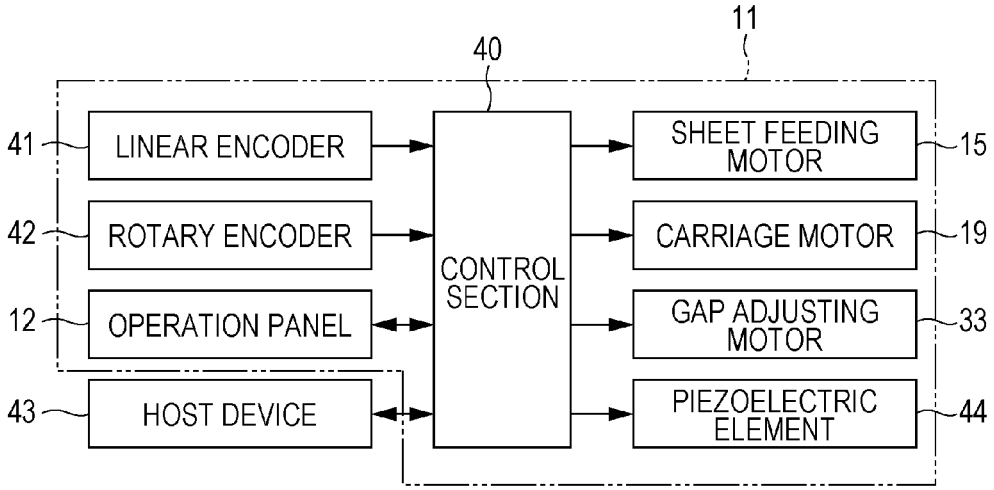
FIG. 4 is a block diagram showing an electrical arrangement of the printer.

As shown in FIG. 4, the printer 11 includes a control section 40 that collectively controls an operation state of the printer 11. To an input-side interface (not shown) of the control section 40, a linear encoder 41, a rotary encoder 42, the operation panel 12, and a host device 43 are electrically connected. The linear encoder 41 outputs, when the carriage 17 provided with the liquid ejection head 21 is moved in the scanning direction, pulse signals whose number is proportional to an amount of the movement. The control section 40 estimates the location of the carriage 17, i.e., the location of the liquid ejection head 21 in the scanning direction on the basis of the pulse signals received from the linear encoder 41. The rotary encoder 42 outputs, when the sheet feeding motor 15 is driven so as to rotate to transport the sheet P in the Y direction, the number of pulses of the signal is proportional to the amount of rotation. The control section 40 estimates the amount of movement of the sheet P in the transporting direction on the basis of the signal pulses received from the rotary encoder 42.

In response to an on/off operation etc. of the power button 12*a*, the operation panel 12 outputs a signal indicative of the content of the operation. Based on the signal received from the operation panel 12, the control section 40 turns on/off the printer 11 or switches various operations. Moreover, the control section 40 supplies a signal for displaying an execution state of the operation to the operation panel 12 and causes the display section 12*b* of the operation panel 12 to display the content of the execution. The host device 43 is, for example, a personal computer. The host device 43 generates image data or test data in accordance with a printing condition or a maintenance condition set by a user of the printer 11 and then outputs a signal indicative of the content of the data. Based on the signal received from the host device 43, the control section 40 controls a printing operation and a maintenance operation in the printer 11. Moreover, the control section 40 supplies a signal indicative of the content of the control that is being executed to the host device 43 side and then causes a display section (not shown) or the like of the host device 43 to display the content of the control.

Meanwhile, the sheet feeding motor 15, the carriage motor 19, the gap adjusting motor 33, and a piezoelectric element 44 are electrically connected to an output-side interface (not shown) of the control section 40. The control section 40 controls driving of the sheet feeding motor 15, the carriage motor 19, the gap adjusting motor 33 and the piezoelectric element 44. That is, the control section 40 is capable of adjusting the speed of transportation of the sheet P and the amount of transportation of the sheet P in the Y direction by controlling a driving state of the sheet feeding motor 15. Moreover, the control section 40 is capable of adjusting the speed of movement of the carriage 17 and the liquid ejection head 21 with respect to the sheet P in the scanning direction and the amount of movement of the carriage 17 and the liquid ejection head 21 in the X direction by controlling the driving state of the carriage motor 19. Moreover, the control section 40 is capable of adjusting the print gap PG between the nozzle formation surface 21*a* of the liquid ejection head 21 and the supporting surface 14*a* of the support 14 as described above by controlling the driving state of the gap adjusting motor 33. Moreover, the control section 40 is capable of adjusting the speed of discharge of ink droplets discharged from the nozzles 30 of the liquid ejection head 21 by controlling the voltage applied to the piezoelectric element 44.

In this respect, in the present embodiment, the piezoelectric element 44 functions as a discharge driving section that is driven when ink is discharged from the nozzles (discharge openings) in the form of ink droplets.

Next, the following describes how the printer 11 configured as above works, especially how the printer 11 works in a case where ink droplets are discharged from the nozzle 30 on the basis of test data in order to detect whether the liquid ejection head 21 is inclined or not.

In a case where the liquid ejection head 21 is inclined in comparison with a case where the liquid ejection head 21 is mounted in the carriage 17 in a proper posture, various forms of inclination can be assumed. The following discusses, as representative examples, a case where the liquid ejection head 21 is inclined about an axis extending in the X direction and a case where the liquid ejection head 21 is inclined about an axis extending in the Y direction.

Figure 5:
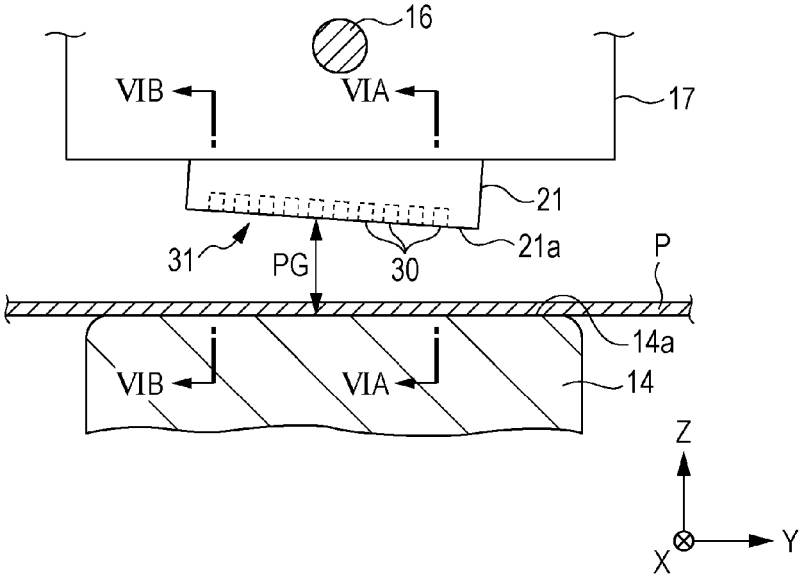
FIG. 5 is a schematic view showing a state where a liquid ejection head is inclined about an axis extending in an X direction.

First, a case where the liquid ejection head 21 is mounted in the carriage 17 so as to have a very small inclination about the axis extending in the X direction as shown in FIG. 5 is explained.

In such a case, in a case where a test pattern for determination of a shift in ink droplet adhesion position on the sheet P is formed in order to determine whether the liquid ejection head 21 is inclined or not, the following processes are executed in the printer 11. Note that it is assumed that the control section 40 executes a first process beforehand in the printer 11. The first process is a process for forming a printed image on the sheet P by discharging ink droplets from the liquid ejection head 21 onto the sheet P on the basis of image data in response to an image data signal received from the host device 43. In other words, the control section 40 is capable of executing the first process for forming an image on a medium (sheet P) by discharging droplets (ink droplets) from a discharging section (the liquid ejection head 21) on the basis of image data. Assume that the process for forming a test pattern is a second process, the control section 40 is capable of executing the second process for forming a test pattern for determination of a shift in droplet (ink droplet) adhesion position on a medium (sheet P) by discharging droplets (ink droplets) from the discharging section (the liquid ejection head 21) on the basis of test data. It should be noted that the image data can be any image data.

It is assumed that, in the first process, the print gap PG in the top-bottom direction between the nozzle formation surface 21*a* of the liquid ejection head 21 and the supporting surface 14*a* of the support 14 is set to the shortest print gap adjustable by driving of the gap adjusting motor 33. In FIG. 5, for convenience of explanation, an inclination angle of the nozzle formation surface 21*a* of the liquid ejection head 21 with respect to the supporting surface 14*a* of the support 14 is exaggerated. Under the above assumptions, when the test data signal is supplied from the host device 43 to the control section 40 of the printer 11, the control section 40 executes the second process as follows.

Specifically, the control section 40 first controls driving of the gap adjusting motor 33 so as to move the nozzle formation surface 21*a* of the liquid ejection head 21 and the supporting surface 14*a* of the support 14 relative to each other in the top-bottom direction so that the print gap PG between the liquid ejection head 21 and the support 14 is longer than the shortest gap, which is the print gap employed in the first process. More specifically, the gap adjusting motor 33 is driven so that the pinion 34 is rotated in a counterclockwise direction in FIG. 2. This lifts up the rack member 32 that meshes with the pinion 34, and the sub-carriage 17B is lifted up together with the rack member 32.

As a result, the liquid ejection head 21 provided on the bottom of the sub-carriage 17B also moves upward, i.e., moves in a direction in which the nozzle formation surface 21*a* moves away from the supporting surface 14*a* of the support 14.

Next, the control section 40 controls driving of the carriage motor 19 in a state in which driving of the sheet feeding motor 15 is stopped. By thus controlling driving of the carriage motor 19, the control section 40 causes the carriage 17 provided with the liquid ejection head 21 to move in the scanning direction so that the liquid ejection head 21 and the sheet P supported on the supporting surface 14*a* of the support 14 move relative to each other in the X direction, which is the scanning direction. In this case, the control section 40 controls a driving state of the carriage motor 19 so that the speed of movement of the carriage 17 (the liquid ejection head 21) is higher than that in the first process.

Next, the control section 40 controls driving of the piezoelectric element 44 corresponding to a predetermined nozzle array 31 (e.g., the nozzle array 31K that discharges black ink) of the liquid ejection head 21 so that ink droplets are discharged from the nozzles 30 of this nozzle array 31 onto the sheet P. In this way, a test pattern for determination of a shift in ink droplet adhesion position is formed. In this case, the control section 40 controls a driving state of the piezoelectric element 44 so that the speed of discharge of the ink droplets based on the test data is lower than that based on the image data in the first process.

With reference to FIGS. 6 and 7, a case where ink droplets are discharged from the nozzles 30 on the basis of test data in a comparative example and a case where ink droplets are discharged from the nozzles 30 on the basis of test data in the second process according to the present embodiment are compared.

Figure 6A:
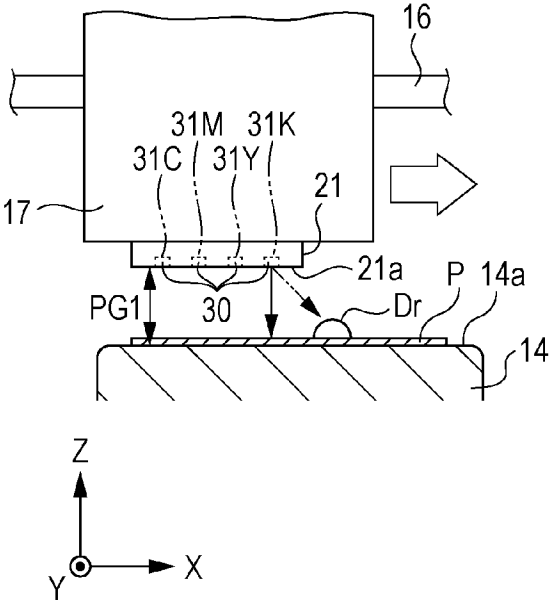
FIG. 6A is a schematic view taken along the line VIA-VIA in FIG. 5.
Figure 6B:
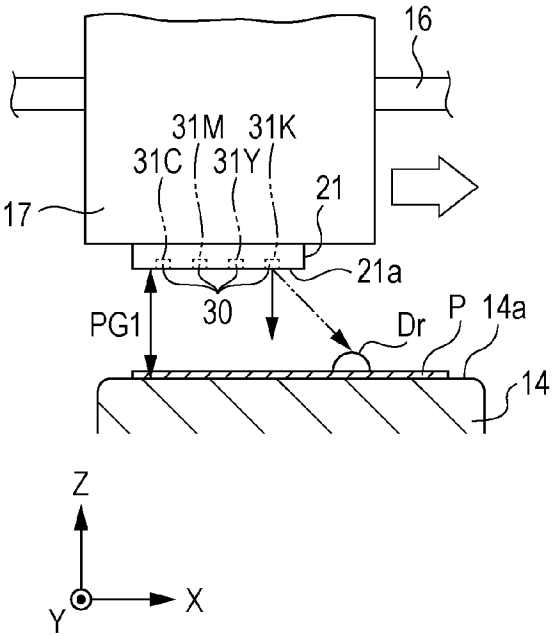
FIG. 6B is a schematic view taken along the line VIB-VIB in FIG. 5.

As shown in FIGS. 6A and 6B, in the comparative example, also in a case where ink droplets are discharged on the basis of test data, the print gap PG between the liquid ejection head 21 and the support 14 is kept at the shortest print gap PG1, which is the print gap employed in the first process for image printing. Moreover, the speed of movement of the carriage 17 (the liquid ejection head 21) also is not particularly changed from that employed in the first process and is kept at the same speed as that in the first process. Moreover, ink droplets Dr are discharged from the liquid ejection head 21 onto a sheet P at the same discharge speed as that in the first process for image printing while the carriage 17 is being moved in the scanning direction indicated by the white arrow in FIGS. 6A and 6B.

Figure 6C:
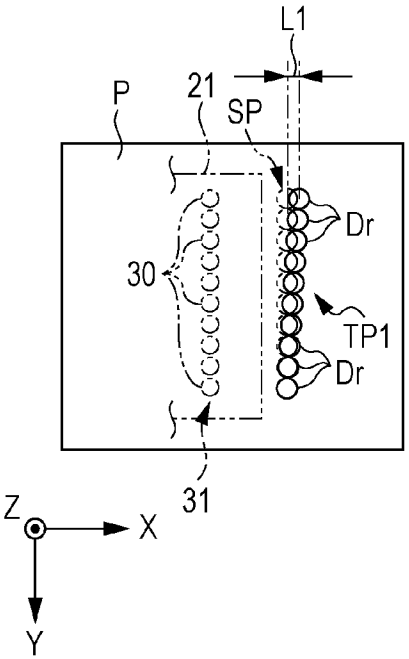
FIG. 6C is a plan view showing a test pattern formed on a sheet in a case where a PG is the one shown in FIGS. 6A and 6B.

Then, as shown in FIG. 6C, a linear test pattern TP1 corresponding to the nozzle array 31 that discharged the ink droplets Dr onto the sheet P is formed. However, the test pattern TP1 in this comparative example is shifted by a very small shift amount L from an ideal supposed pattern SP that is supposed to be formed on the sheet P in a case where the liquid ejection head 21 is correctly mounted at a proper position in the carriage 17 without inclination. It is therefore difficult to visually determine whether adhesion positions of the ink droplets Dr are shifted or not, i.e., whether the test pattern TP1 is shifted from the supposed pattern SP or not.

Figure 7A:
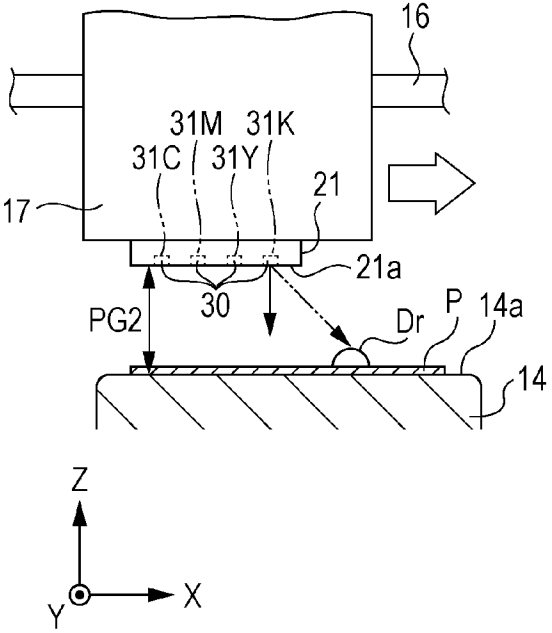
FIGS. 7A and 7B are schematic views each showing a case where the PG is larger than that in FIGS. 6A and 6B.
Figure 7B:
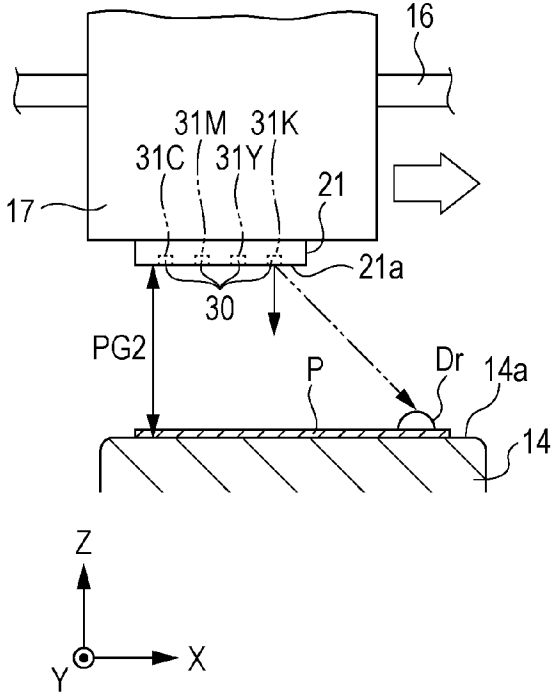

In contrast to this, in the present embodiment, in a case where ink droplets are discharged on the basis of test data, the print gap PG between the liquid ejection head 21 and the support 14 is set to a print gap PG2 longer than the shortest print gap PG1 employed in the first process for image printing, as shown in FIGS. 7A and 7B. In general, in a case where an image is formed by discharging ink droplets from the nozzles 30 of the liquid ejection head 21 on the basis of image data, it is desirable that the print gap between the nozzle formation surface 21*a* of the liquid ejection head 21 and the supporting surface 14*a* of the support 14 be longer than the thickness of the sheet P but be as short as possible, also from the viewpoint of forming a high-quality image by inhibiting ink droplets from flying astray. Accordingly, in many cases, a print gap employed in the first process for forming an image on the sheet P is set to the shortest one adjustable by the gap adjusting section. Therefore, in a case where the second process is executed while keeping the print gap employed in the first process, there is a possibility that, in a case where the degree of shift in ink droplet adhesion position is very small, it cannot be determined even by the test pattern formed on the sheet P whether adhesion positions of the ink droplets are shifted or not. Because of this, in the present embodiment, the print gap PG2 employed in the second process is set to a print gap longer than the print gap PG1 employed in the first process. Furthermore, the ink droplets Dr are discharged from the liquid ejection head 21 onto the sheet P at a lower discharge speed than that employed in the first process while the carriage 17 (the liquid ejection head 21) is being moved in the scanning direction indicated by the white arrow in FIGS. 7A and 7B at a speed higher than that employed in the first process.

Figure 7C:
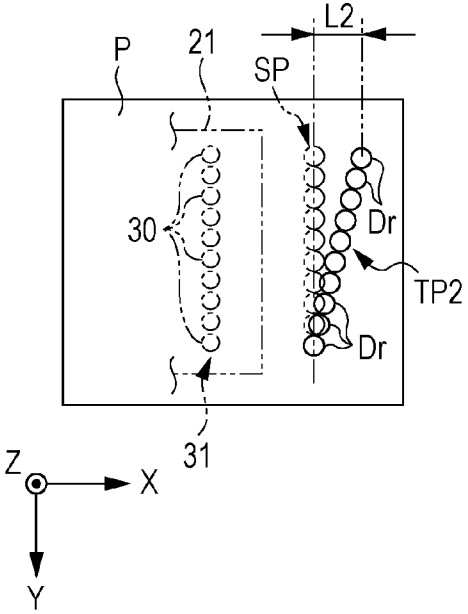
FIG. 7C is a plan view showing a test pattern formed on a sheet in a case where the PG is the one shown in FIGS. 7A and 7B.

Then, a linear test pattern TP2 corresponding to the nozzle array 31 that discharged the ink droplets Dr onto the sheet P is formed as shown in FIG. 7C. In this case, the test pattern TP2 is shifted by a largely exaggerated shift amount L2 from the supposed pattern SP formed in a case where the liquid ejection head 21 is mounted in a proper posture without inclination. This makes it easier to visually determine whether adhesion positions of the ink droplets Dr are shifted or not, i.e., whether the test pattern TP2 is shifted from the supposed pattern SP.

It can be estimated that the shift amount L2 of the test pattern TP2 according to the present embodiment from the supposed pattern SP is more exaggerated than the shift amount L1 of the test pattern TP1 of the comparative example for the following reasons. Specifically, in a case where the print gap PG2, which is longer than the print gap PG1, is employed, a distance of movement of the ink droplets Dr from the nozzles 30 to the sheet P is longer. An amount of shift in ink droplet adhesion position that occurs in a case where a discharge direction of the ink droplets Dr is inclined from a normal one becomes larger depending on the distance of movement. Accordingly, as the distance of movement of the ink droplets Dr becomes longer, the amount L2 of shift in adhesion positions of the ink droplets Dr becomes larger. Furthermore, in a case where the liquid ejection head 21 and the sheet P are moved relative to each other, a relative position between the liquid ejection head 21 and the sheet P changes largely by the time when the ink droplets Dr reach the sheet P. This increases the amount L2 of shift in adhesion positions of the ink droplets Dr. Furthermore, air resistance which the ink droplets Dr receive while traveling from the nozzles 30 to the sheet P becomes larger. This large air resistance lowers the discharge speed. Accordingly, in a case where the liquid ejection head 21 and the sheet P are moved relative to each other, a relative position between the liquid ejection head 21 and the sheet P changes largely by the time when the ink droplets Dr reach the sheet P. This increases the amount L2 of shift in adhesion positions of the ink droplets Dr.

Furthermore, the high speed of movement of the liquid ejection head 21 relative to the sheet P and the low speed of discharge of the ink droplets Dr from the liquid ejection head 21 onto the sheet P also increase an amount of movement of the ink droplets Dr discharged from the nozzles 30 onto the sheet P in the relative movement direction (the scanning direction). This also increases the amount L2 of shift in adhesion positions of the ink droplets Dr.

Figure 8:
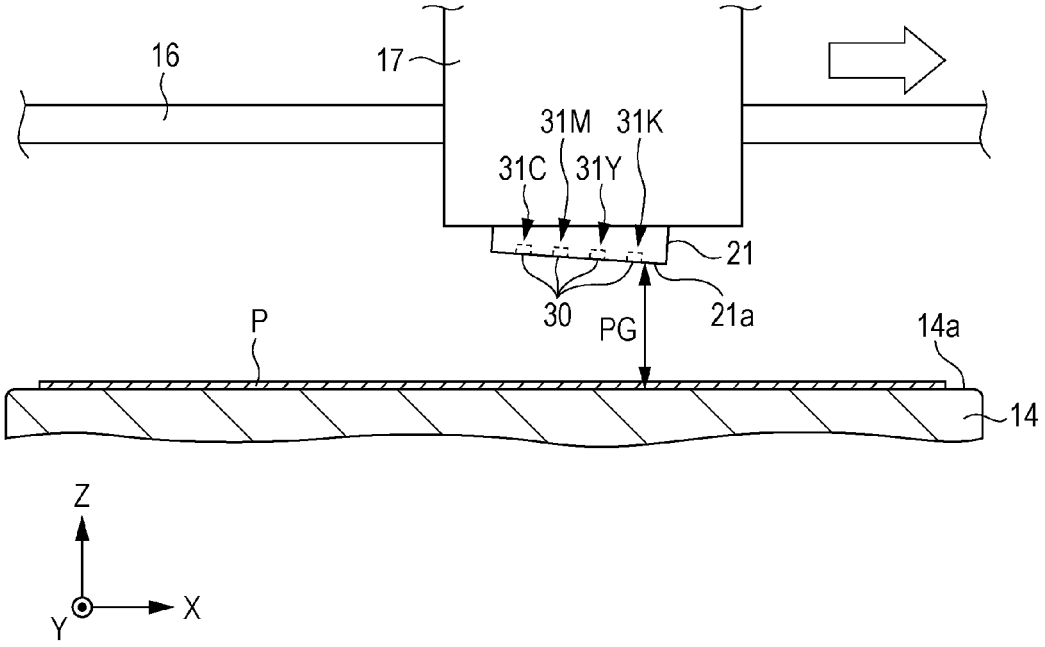
FIG. 8 is a schematic view showing a state where the liquid ejection head is inclined about the axis extending in the Y direction.

Next, a case where the liquid ejection head 21 is mounted in the carriage 17 so as to have very small inclination about the axis extending in the Y direction as shown in FIG. 8 is explained.

In such a case, the second process is executed as follows in a case where a test pattern for determination of shift in ink droplet adhesion position on a sheet P is formed to determine whether the liquid ejection head 21 is inclined or not, after execution of the first process for forming a printed image on the sheet P by discharging ink droplets from the liquid ejection head 21 onto the sheet P on the basis of image data.

Specifically, as in the case described above with reference to FIGS. 6 and 7 where the liquid ejection head 21 is mounted in the carriage 17 so as to have very small inclination about the axis extending in the X direction, the print gap PG between the liquid ejection head 21 and the support 14 is set to the print gap PG2 longer than the shortest print gap PG1 employed in the first process. In other words, the second process is executed in a state in which the print gap PG is longer than the shortest gap adjustable by the gap adjusting section. Furthermore, the speed of movement of the liquid ejection head 21 relative to the sheet P is set to the one higher than that employed in the first process. In other words, in a case where the control section 40 executes the second process, the sheet P and the liquid ejection head 21 are moved relative to each other so that the speed of the relative movement of the sheet P and the liquid ejection head 21 is higher than that employed in the first process. Furthermore, the speed of discharge of ink droplets from the liquid ejection head 21 toward the sheet P is set to the one lower than that employed in the first process. In other words, in a case where the control section 40 executes the second process, the speed of discharge of ink droplets from the liquid ejection head 21 is set to the one lower than that employed in the first process. In this way, ink droplets are discharged from the plurality of (for example, four in FIG. 8) nozzle arrays 31 (31C, 31M, 31Y and 31K) onto the sheet P on the basis of the test data. Consequently, as many test patterns as the number of nozzle arrays 31 that discharged the ink droplets are formed on the sheet P in parallel with each other at predetermined intervals.

Figure 9B:
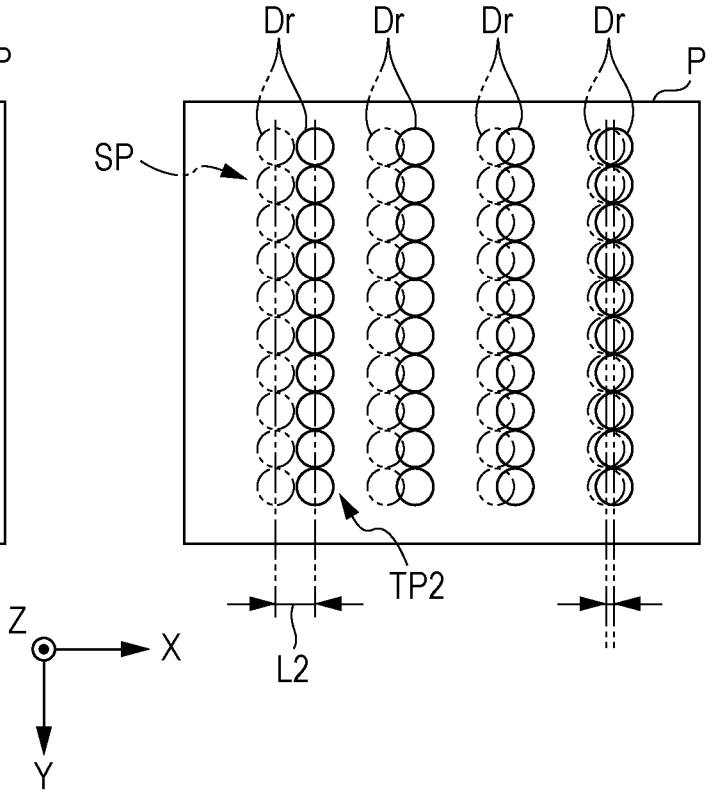
FIG. 9B is a plan view showing a test pattern formed on a sheet in a case where the liquid ejection head is inclined about the axis extending in the Y direction.
Figure 9A:
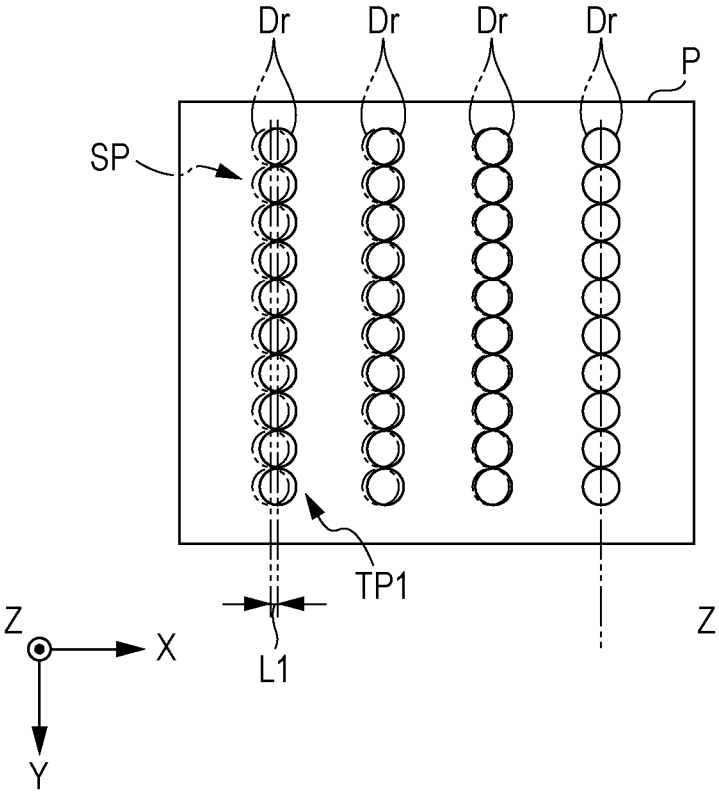
FIG. 9A is a plan view showing a test pattern formed on a sheet in a case where the liquid ejection head is mounted in a proper posture.

In a comparative example, in which the print gap PG between the liquid ejection head 21 and the support 14 is kept the same as the shortest print gap PG1 employed in the first process for image printing, a test pattern TP1 is shifted by a very small shift amount L1 from a supposed pattern SP that is formed in a case where the liquid ejection head 21 is mounted in a proper posture without inclination as shown in FIG. 9A. It is therefore difficult to visually determine whether adhesion positions of the ink droplets Dr are shifted or not, i.e., whether the test pattern TP1 is shifted from the supposed pattern SP or not.

In contrast to this, in the present embodiment, in a case where ink droplets are discharged on the basis of test data, the print gap PG between the liquid ejection head 21 and the support 14 is set to the print gap PG2 longer than the shortest print gap PG1 employed in the first process for image printing. Then, the ink droplets Dr are discharged from the liquid ejection head 21 onto the sheet P at a speed lower than that employed in the first process while the carriage 17 (the liquid ejection head 21) is being moved in the scanning direction indicated by the white arrow in FIG. 8 at a speed higher than that in the first process.

This largely exaggerates a shift amount L2 of a test pattern TP2 formed in this case from the supposed pattern SP formed in a case where the liquid ejection head 21 is mounted in a proper posture without inclination as shown in FIG. 9B. As a result, it becomes easier to visually determine whether adhesion positions of the ink droplets Dr are shifted or not, i.e., whether the test pattern TP2 is shifted from the supposed pattern SP or not.

According to the printer of the first embodiment, the following effects can be obtained:

(1) In a case where the control section 40 executes the second process, the print gap PG between the nozzle formation surface 21*a* of the liquid ejection head 21 and the supporting surface 14*a* of the support 14 is adjusted to the print gap PG2 longer than the print gap PG1 that is the shortest gap adjustable by the gap adjusting motor 33. This increases a distance which the ink droplets Dr move from the nozzles 30 to the sheet P. An amount of shift in ink droplet adhesion position that occurs in a case where a direction in which the ink droplets Dr are discharged is inclined from a normal direction becomes larger in accordance with the distance of movement. Accordingly, as the distance of movement becomes longer, the amount L2 of shift in adhesion positions of the ink droplets Dr becomes larger. Furthermore, in a case where the liquid ejection head 21 and the sheet P are moved relative to each other, a relative position between the liquid ejection head 21 and the sheet P largely changes by the time when the ink droplets Dr reach the sheet P. This increases the amount L2 of shift in adhesion positions of the ink droplets Dr. Furthermore, air resistance which the ink droplets Dr receive while traveling from the nozzles 30 to the sheet P becomes larger. This large air resistance lowers the discharge speed. Accordingly, in a case where the liquid ejection head 21 and the sheet P are moved relative to each other, a relative position between the liquid ejection head 21 and the sheet P largely changes by the time when the ink droplets Dr reach the sheet P. This increases the amount L2 of shift in adhesion positions of the ink droplets Dr. That is, a state of the shift in adhesion positions of the ink droplets Dr in the test pattern TP2 formed on the sheet P is exaggerated. It is therefore possible to easily visually determine whether adhesion positions of ink droplets are shifted or not, even in a case where the degree of the shift in ink droplet adhesion positions is very small.

(2) Even in a case where after execution of the first process for forming an image on a sheet P, the second process for forming a test pattern TP2 on the same sheet P is executed, the print gap PG between the liquid ejection head 21 and the support 14 becomes longer, and a state of shift in adhesion positions of the ink droplets Dr in the test pattern TP2 is exaggerated. It is therefore possible to easily visually determine whether adhesion positions of the ink droplets are shifted or not, even in a case where the degree of the shift in ink droplets adhesion positions is very small.

(3) The arrangement in which the liquid ejection head 21 is moved by driving of the gap adjusting motor 33 requires a smaller space in the printer 11 as compared with a case where the support 14 is moved in a direction away from the liquid ejection head 21. This contributes to a reduction in size of the whole device.

(4) In a case where the control section 40 executes the second process, in which ink droplets are discharged from the nozzles 30 of the liquid ejection head 21 that moves relative to the sheet P, the speed of relative movement between the sheet P and the liquid ejection head 21 becomes higher. Accordingly, in a case where a shift in ink droplet adhesion position has occurred, the amount L2 of the shift in ink droplet adhesion position on the sheet P becomes larger. That is, the state of the shift in ink adhesion position in the test pattern TP2 formed on the sheet P is further exaggerated. It is therefore possible to more easily visually determine whether adhesion positions of the ink droplets are shifted or not, even in a case where the degree of the shift in ink droplets adhesion position is very small.

(5) In a case where the control section 40 executes the second process, in which ink droplets are discharged from the nozzles 30 of the liquid ejection head 21 that moves relative to the sheet P, the speed of discharge of the ink droplets from the nozzles 30 becomes lower. Accordingly, in a case where a shift in ink droplet adhesion position occurs, the amount L2 of shift in ink droplet adhesion position on the sheet P becomes larger. That is, the state of the shift in ink adhesion position in the test pattern TP2 formed on the sheet P is further exaggerated. It is therefore possible to more easily visually determine whether adhesion positions of the ink droplets are shifted or not, even in a case where the degree of the shift in ink droplets adhesion position is very small.

(6) In a so-called serial type printer 11 in which the liquid ejection head 21 discharges ink droplets onto a sheet P while moving in a scanning direction orthogonal to a direction in which the sheet P is transported, it is possible to easily adjust an exaggerated state of shift in ink droplet adhesion position in the test pattern TP2 by adjusting the speed of movement of the liquid ejection head 21.

Second Embodiment

Next, with reference to FIGS. 10 through 15, the following describes an ink jet printer (one example of a droplet discharge device) according to the second embodiment and a method for discharging ink droplets in the printer (droplet discharge method).

Figure 10:
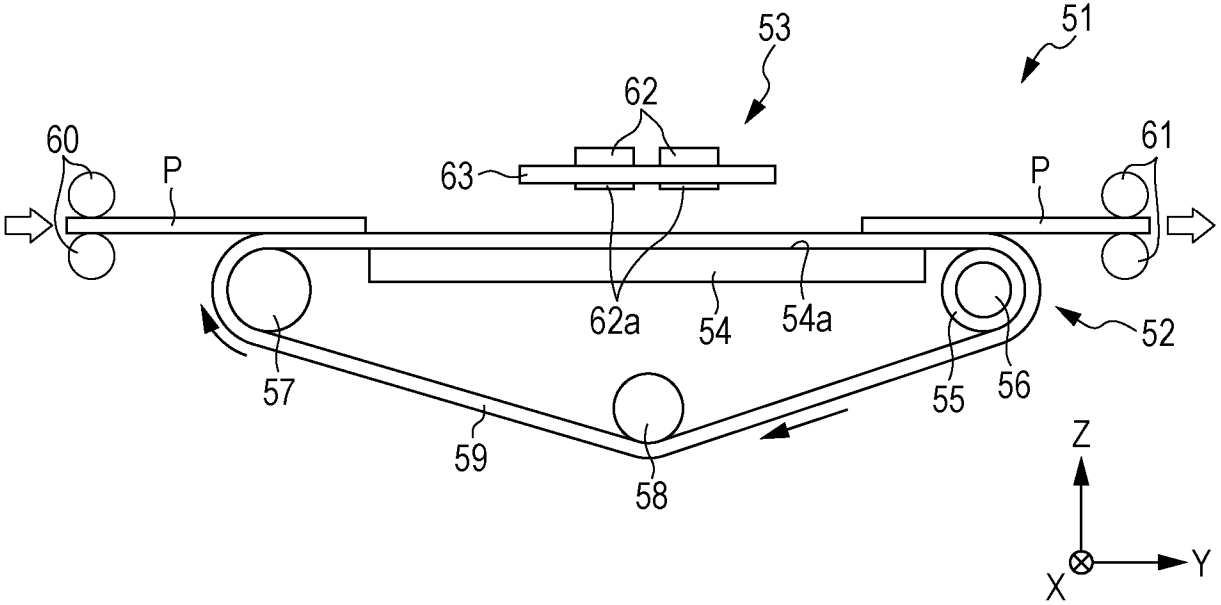
FIG. 10 is a schematic view showing a configuration of a line head type printer according to a second embodiment.

As shown in FIG. 10, an ink jet printer 51 according to the present embodiment includes a transporting unit 52 for transporting a sheet P and a liquid ejection head 53 (discharging section) for discharging ink droplets to form a printed image on the sheet P. It should be noted that a transporting direction in which the sheet P is transported is the Y direction, i.e., the rightward direction in FIG. 10, and the liquid ejection head 53 is located on the upper side of the sheet P, i.e., the antigravity direction (the Z direction) side of the sheet P.

The transporting unit 52 includes a support 54 (supporting member) that has a predetermined length in the left-right direction and has a rectangular plate shape. A top surface of the support 54 is a supporting surface 54*a* on which the sheet P is supported. On the right side of the support 54, a driving roller 55 that extends in the front-rear direction (direction orthogonal to the surface of the paper on which the drawings are drawn) is provided so as to be rotationally drivable by a driving motor 56. On the left side of the support 54, a driven roller 57 that extends in the front-rear direction is rotatably provided. On the lower side of the support 54, a tension roller 58 that extends in the front-rear direction is rotatably provided.

Around the driving roller 55, the driven roller 57 and the tension roller 58, a transporting belt 59 that is an endless belt having a large number of through-holes (not shown) is wound so as to surround the support 54. In this case, the tension roller 58 is urged downward by a spring member (not shown). This gives tension to the transporting belt 59, thereby preventing the transporting belt 59 from slacking.

Through rotational driving of the driving roller 55, the transporting belt 59 circles along an outer side of the driving roller 55, the tension roller 58, and the driven roller 57 in a clockwise direction when viewed from the front side (the front surface side of the paper on which the drawings are drawn). In a case where the sheet P is on the supporting surface 54*a* of the support 54, the sheet P is transported from the left side (the upstream side of the transporting direction) toward the right side (the downstream side of the transporting direction) while being sucked toward the support 54 side through the transporting belt 59 by a sucking section (not shown).

On the upper left side of the driven roller 57, a pair of upper and lower feeding rollers 60 for sequentially feeding a plurality of unprinted sheets P one by one onto the transporting belt 59 is provided. On the upper right side of the driving roller 55, a pair of upper and lower sheet discharging rollers 61 for discharging the printed sheets P supplied from the transporting belt 59 one by one is provided.

Figure 11:
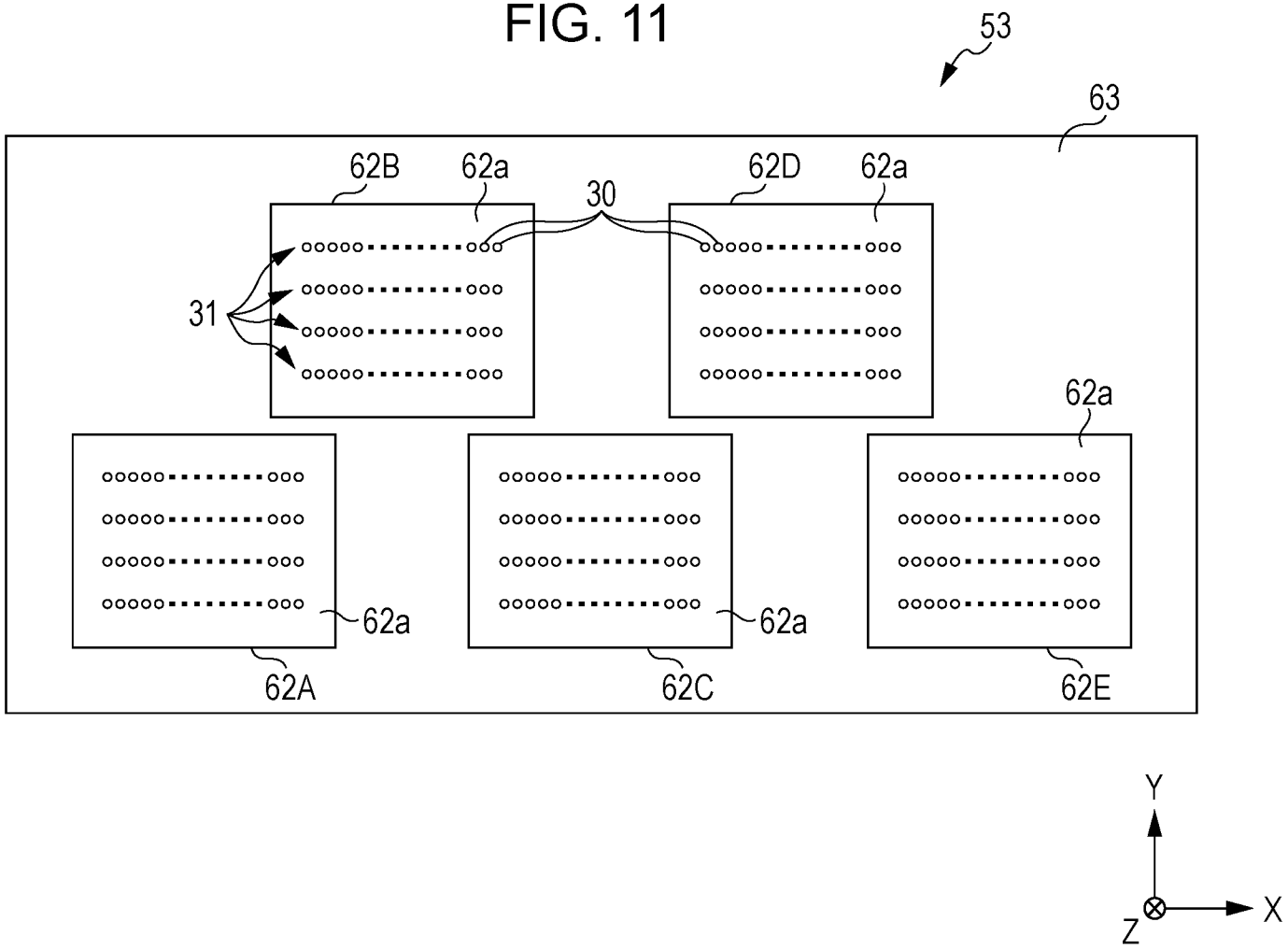
FIG. 11 is a schematic view showing a bottom surface of a recording head of the printer.

As shown in FIGS. 10 and 11, the liquid ejection head 53 includes a plurality of (five in the present embodiment) unit heads 62 (62A through 62E) arranged along the width direction of the sheet P (the front-rear direction) and a supporting plate 63 on which the unit heads 62 are supported. As shown in FIG. 11, the unit heads 62 are arranged in two lines in the left-right direction so that they are not in line with each other in the front-rear direction (i.e., staggered arrangement). On a nozzle formation surface 62*a* which is a bottom surface of each of the unit heads 62, a plurality of (four in the present embodiment) nozzle arrays 31 each of which is made up of a plurality of nozzles 30 are arranged along the front-rear direction. The nozzle arrays 31 are provided at regular predetermined intervals in the left-right direction.

Ink of different colors is supplied to the respective nozzle arrays 31, and the ink is ejected toward the sheet P from the nozzles 30 of the nozzle arrays 31. For example, the colors of the ink supplied to the nozzle arrays 31 are, from the right side to the left side, black, cyan, magenta, and yellow. Then, the ink is discharged in the form of ink droplets from the nozzles 30 of the unit heads 62 onto the sheet P transported in the transporting direction below the liquid ejection head 53 that is kept at a fixed state. In this way, an image is formed on the sheet P. It can therefore be said that the printer 51 according to the present embodiment is a so-called line head type printer (droplet discharge device) in which ink droplets are discharged from the liquid ejection head 53 that is disposed in a fixed state onto the sheet P moving in the transporting direction.

In the present embodiment, the supporting plate 63 on which the unit heads 62 are supported is movable in the top-bottom direction in which the nozzle formation surfaces 62*a* of the unit heads 62 and the supporting surface 14*a* of the support 14 face each other. Accordingly, a print gap PG1, PG2 between the liquid ejection head 53 and the support 54 is adjustable in accordance with driving of a motor (not shown) functioning as a gap adjusting section. Furthermore, in the present embodiment, the driving motor 56 that rotationally drives the driving roller 55 of the transporting unit 52 functions as a movement driving section that is driven when the sheet P and the liquid ejection head 53 are moved relative to each other. As in the case of the printer 11 according to the first embodiment, also in the present embodiment, a control section is capable of adjusting the speed of discharge of ink droplets discharged from the nozzles 30 of the liquid ejection head 53 by controlling a voltage applied to a piezoelectric element, and the piezoelectric element functions as a discharge driving section that is driven when ink is discharged in the form of ink droplets from the nozzles 30.

Next, the following describes how the printer 51 configured as above works, especially how the printer 51 works in a case where ink droplets are discharged from the nozzles 30 on the basis of test data in order to detect whether the liquid ejection head 53 (more specifically, the unit heads 62) is inclined or not.

Figure 12:
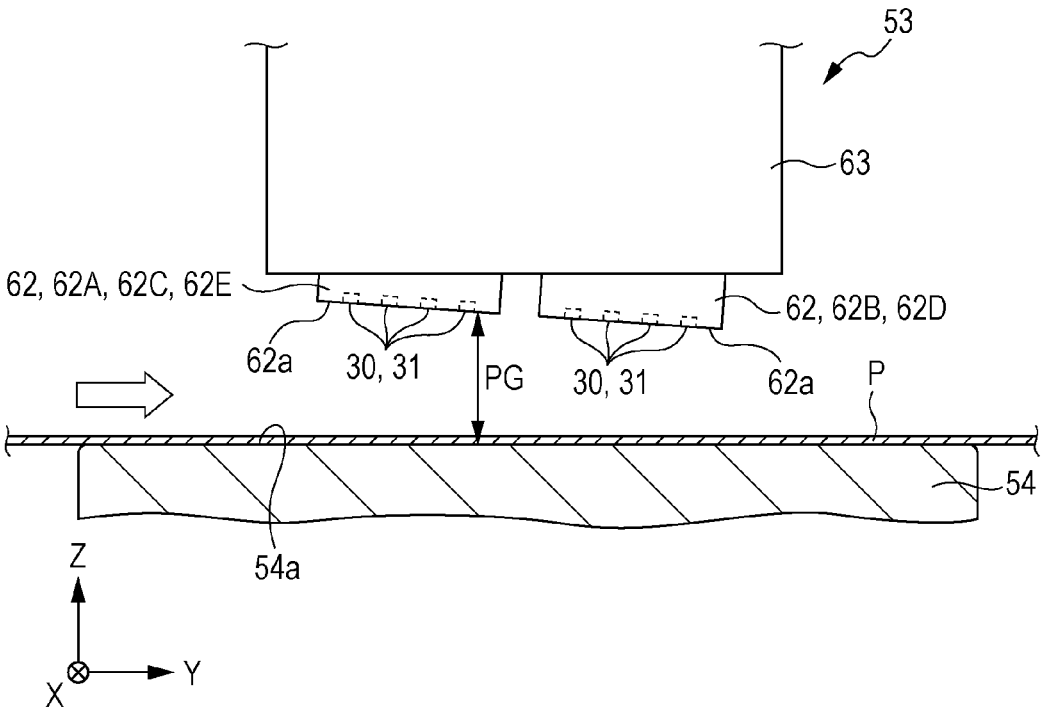
FIG. 12 is a schematic view showing a state where the recording head is inclined about an axis extending in an X direction.

First, a case where the unit heads 62 of the liquid ejection head 53 are provided so as to have very small inclination about the axis extending in the X direction with respect to the supporting plate 63 as shown in FIG. 12 is explained.

In such a case, a second process is executed as follows in a case where a test pattern for determination of shift in ink droplet adhesion position on a sheet P is formed to determine whether the unit heads 62 are inclined or not, after execution of a first process for forming a printed image on the sheet P by discharging ink droplets from the unit heads 62 onto the sheet P on the basis of image data.

Specifically, the control section 40 controls driving of the motor functioning as the gap adjusting section so that the print gap between the unit heads 62 of the liquid ejection head 53 and the support 54 is longer than the shortest print gap employed in the first process. Furthermore, the control section 40 controls driving of the driving motor 56 so that the speed of movement of the sheet P relative to the unit heads 62 is higher than that in the first process. Furthermore, the control section 40 controls driving of the piezoelectric element so that the speed of discharge of ink droplets discharged from the unit heads 62 of the liquid ejection head 53 toward the sheet P is lower than that in the first process. In this way, ink droplets are discharged from the nozzles 30 of the plurality of (e.g., four in FIG. 12) nozzle arrays 31 onto the sheet P on the basis of test data. As a result, as many test patterns as the number of nozzle arrays 31 that discharged the ink droplets are formed on the sheet P in parallel with each other at predetermined intervals.

Figure 13B:
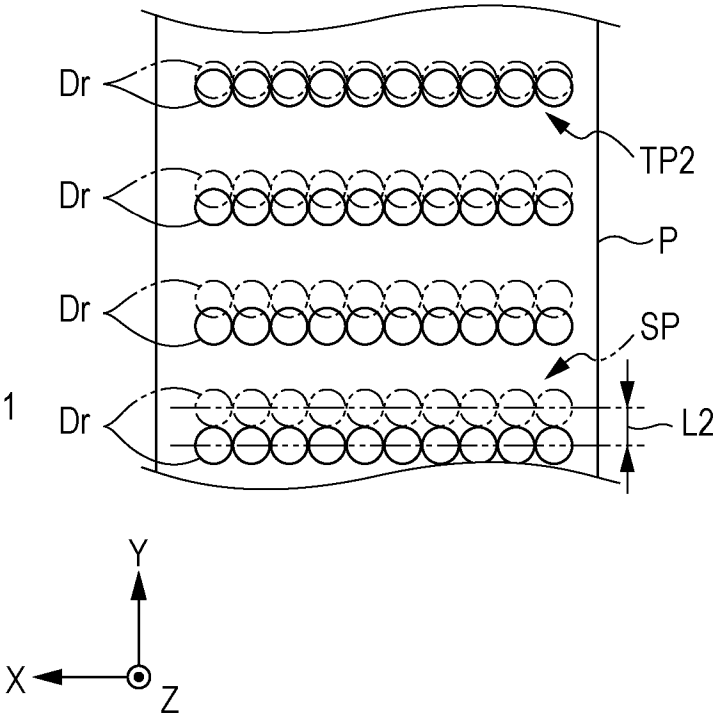
FIG. 13B is a plan view showing a test pattern formed on a sheet in a case where the recording head is inclined about the axis extending in the X direction.
Figure 13A:
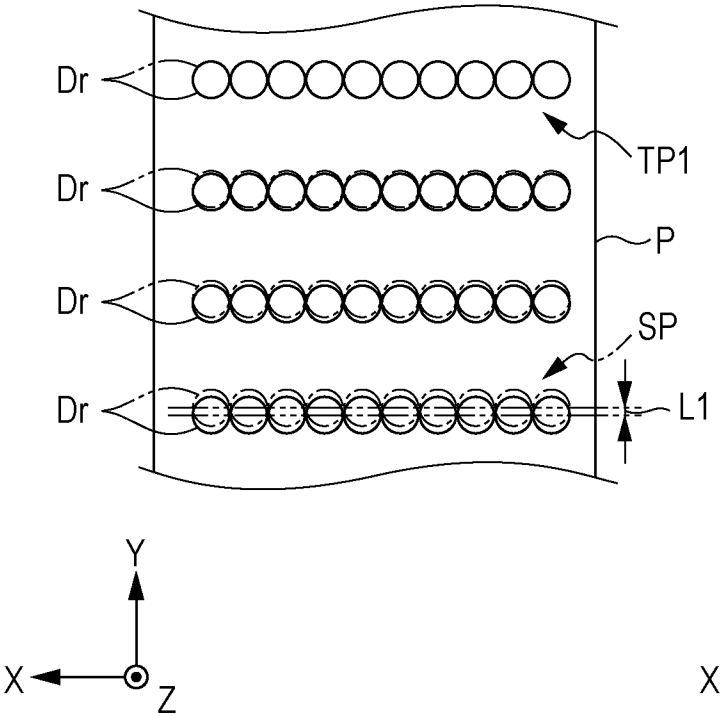
FIG. 13A is a plan view showing a test pattern formed on a sheet in a case where the recording head is mounted in a proper posture.

In a comparative example in which the print gap PG between the unit heads 62 of the liquid ejection head 53 and the support 54 is kept the same as the shortest print gap employed in the first process for image printing, a test pattern TP1 is shifted by a very small shift amount TP1 from a supposed pattern SP that is formed in a case where the unit heads 62 are mounted in a proper posture without inclination as shown in FIG. 13A. It is therefore difficult to visually determine whether adhesion positions of the ink droplets Dr are shifted or not, i.e., whether the test pattern TP1 is shifted from the supposed pattern SP or not.

In contrast to this, in the present embodiment, in a case where ink droplets are discharged on the basis of test data, the print gap PG between the unit heads 62 of the liquid ejection head 53 and the support 54 is set to the one longer than the shortest print gap employed in the first process for image printing. Then, the ink droplets Dr are discharged from the unit heads 62 onto the sheet P at a speed lower than that employed in the first process while the sheet P is being moved in the transporting direction indicated by the white arrow in FIG. 12 at a speed higher than that in the first process.

This largely exaggerates a shift amount L2 of a test pattern TP2 formed in this case from the supposed pattern SP formed in a case where the unit heads 62 of the liquid ejection head 53 are mounted in a proper posture without inclination with respect to the supporting plate 63 as shown in FIG. 13B. As a result, it becomes easier to visually determine whether adhesion positions of the ink droplets Dr are shifted or not, i.e., whether the test pattern TP2 is shifted from the supposed pattern SP or not.

Figure 14:
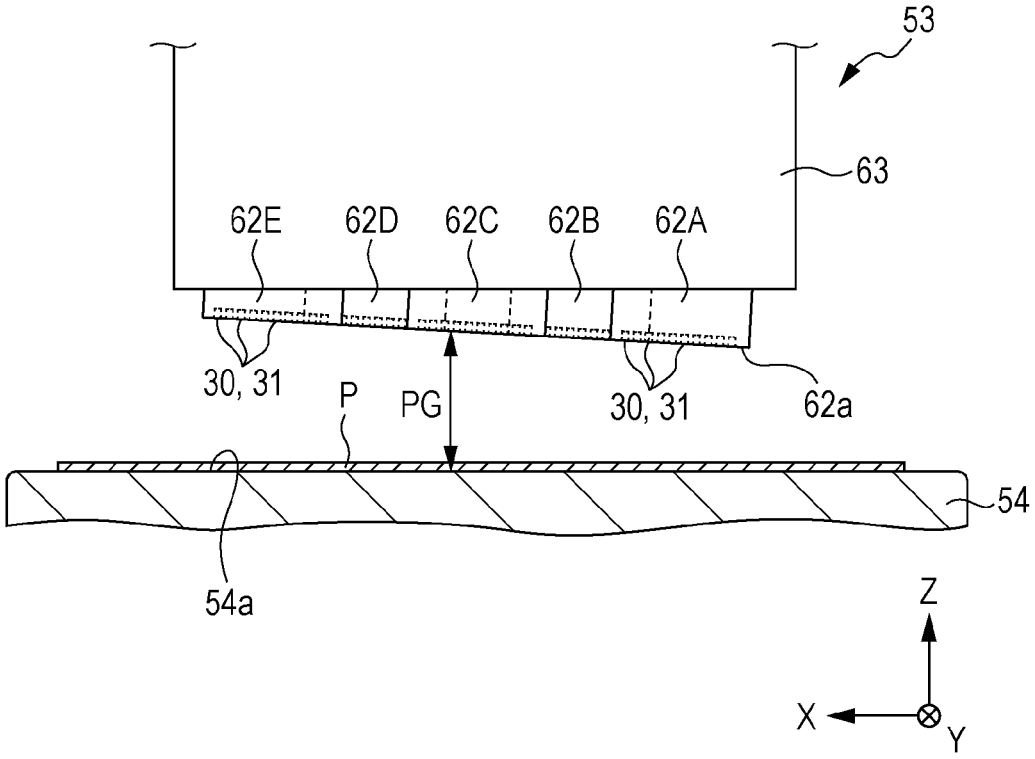
FIG. 14 is a schematic view showing a state where the recording head is inclined about the axis extending in a Y direction.

Next, a case where the unit heads 62 of the liquid ejection head 53 are provided so as to have very small inclination about the axis extending in the Y direction with respect to the supporting plate 63 as shown in FIG. 14 is explained.

Also in this case, the second process is executed as follows in a case where a test pattern for determination of shift in ink droplet adhesion position on a sheet P is formed to determine whether the liquid ejection head 21 is inclined or not, after execution of the first process for forming a printed image on the sheet P by discharging ink droplets from the unit heads 62 onto the sheet P on the basis of image data.

Specifically, as in the case described above with reference to FIGS. 12 and 13 where the unit heads 62 are mounted so as to have very small inclination about the axis extending in the X direction with respect to the supporting plate 63, the print gap between the unit heads 62 and the support 54 is set to the one longer than the shortest print gap employed in the first process. Furthermore, the speed of movement of the sheet P relative to the unit heads 62 is set to the one higher than that employed in the first process, and the speed of discharge of ink droplets from the unit heads 62 toward the sheet P is set to the one lower than that employed in the first process. In this way, ink droplets are discharged from the nozzles 30 of all of the nozzle arrays 31 of the unit heads 62 onto the sheet P on the basis of the test data. Consequently, as many test patterns as the number of nozzle arrays 31 that discharged the ink droplets are formed on the sheet P in parallel with each other at predetermined intervals.

Figure 15B:
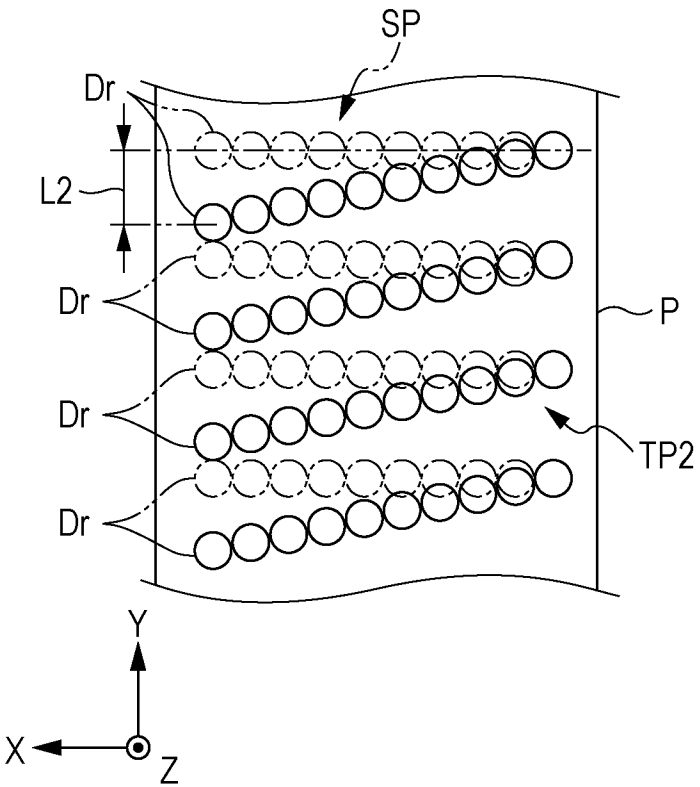
FIG. 15B is a plan view showing a test pattern formed on a sheet in a case where the recording head is inclined about the axis extending in the Y direction.
Figure 15A:
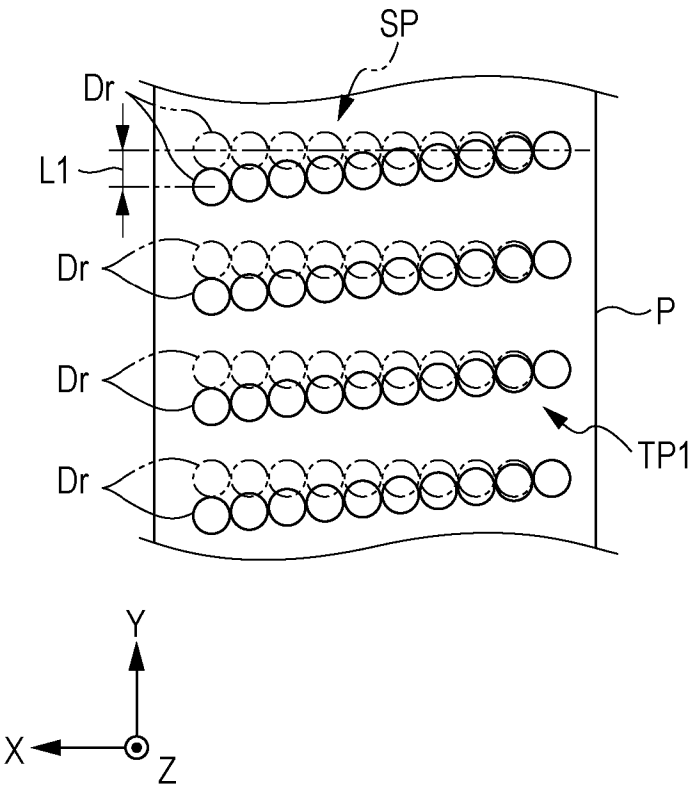
FIG. 15A is a plan view showing a test pattern formed on a sheet in a case where the recording head is mounted in a proper posture.

In a comparative example in which the print gap PG between the unit heads 62 of the liquid ejection head 53 and the support 54 is kept the same as the shortest print gap employed in the first process for image printing, a test pattern TP1 is shifted by a very small shift amount L1 from the supposed pattern SP that is formed in a case where the unit heads 62 are mounted in a proper posture without inclination as shown in FIG. 15A. It is therefore difficult to visually determine whether adhesion positions of the ink droplets Dr are shifted or not, i.e., whether the test pattern TP1 is shifted from the supposed pattern SP or not.

In contrast to this, a test pattern TP2 according to the present embodiment is shifted by a largely exaggerated shift amount L2 from the supposed pattern SP formed in a case where the unit heads 62 of the liquid ejection head 53 are mounted in a proper posture without inclination with respect to the supporting plate 63 as shown in FIG. 15B. As a result, it becomes easier to visually determine whether adhesion positions of the ink droplets Dr are shifted or not, i.e., whether the test pattern TP2 is shifted from the supposed pattern SP or not.

According to the printer 51 of the second embodiment, the following effect can be obtained in addition to the effects substantially the same as the above-mentioned effects (1) through (5) obtained by the printer 11 according to the first embodiment. Specifically, it is possible to easily adjust an exaggerated state of the shift in ink droplet adhesion position in the test pattern TP2 by adjusting the speed of movement of the sheet P in the so-called line head type printer 51 in which ink droplets are discharged from the unit heads 62 of the liquid ejection head 53 disposed in a fixed state onto the sheet P moving in the transporting direction.

It should be noted that the above embodiments may be modified as follows:

In each of the above embodiment, the comparison between the test pattern TP2 formed on the sheet P on the basis of test data and the supposed pattern SP may be performed by a method other than visual judgment. For example, the degree of shift in the test pattern TP2 from the supposed pattern SP may be determined by comparing, in the control section, scanned data of the test pattern TP2, which is scanned with an image scanner sensor or the like, with data of the supposed pattern SP. Also in this case, the test pattern TP2 in which the degree of the shift is exaggerated makes it easier to determine whether the shift has occurred or not.

In each of the above embodiment, it is also possible to employ an arrangement in which any one of the following (A) through (C) is performed in the second process: (A) the print gap PG between the liquid ejection head 21, 53 and the support 14, 54 is adjusted to the print gap PG2 that is longer than the shortest print gap PG1 adjustable by the gap adjusting section, (B) the speed of discharge of ink droplets from the liquid ejection head 21, 53 is set to the one lower than that in the first process, (C) the speed of relative movement between the sheet P and the liquid ejection head 21, 53 is set to the one higher than that in the first process. Alternatively, it is also possible to employ an arrangement in which any two of the above (A) through (C) are performed. That is, the state of shift in ink droplet adhesion position in the test pattern TP2 is exaggerated as along as at least one of the above (A) through (C) is performed.

In each of the above embodiment, the droplet discharge device may be one in which a medium (sheet) and a discharging section (liquid ejection head) are not moved relative to each other. For example, it is also possible to employ an arrangement in which the medium (sheet) and the discharging section (liquid ejection head) move at the same speed in the same direction or an arrangement in which the medium and the discharging section do not move at all.

In each of the above embodiment, in a case where the second process is executed, the print gap PG between the liquid ejection head 21, 53 and the support 14, 54 need not necessarily be longer than that in the first process.

In each of the above embodiment, the print gap PG between the liquid ejection head 21, 53 and the support 14, 54 may be adjusted by moving the support 14, 54 toward or away from the liquid ejection head 21, 53. Alternatively, the print gap PG between the liquid ejection head 21, 53 and the support 14, 54 may be adjusted by moving both of the liquid ejection head 21, 53 and the support 14, 54 toward each other or away from each other.

In each of the above embodiment, in a case where the second process is executed, the print gap PG between the liquid ejection head 21, 53 and the support 14, 54 may be the same as or shorter than that in the first process. For example, in a case where the print gap PG in the first process is set to the one longer than the shortest print gap because a sheet P, a disc or the like on which printing is to be performed is thick, the print gap PG may be the same as or shorter than that in the first process as long as it is longer than the shortest adjustable print gap.

In each of the above embodiment, an example in which a shift in droplet (ink droplet) adhesion position is caused by inclination of a discharging section (liquid ejection head) with respect to a medium (sheet) has been described. Note, however, that the cause of the shift in droplet (ink droplet) adhesion position is not limited to this. For example, the invention may be applied to a case where a shift in droplet adhesion position occurs because the droplets fly astray. The invention is applicable to cases where exaggeration of a shift in droplets adhesion position caused by various factors is desired. Application of the invention makes it possible to exaggerate a shift in droplet adhesion position caused by any factor and to easily visually determine whether positions of droplets are shifted or not.

In each of the embodiments, the droplet discharge device may be one that discharges other types of liquid than ink. It should be noted that the state of the liquid discharged in the form of droplets of a minute amount from the droplet discharge device encompass a granular form, a tear form, and a stringy form. The liquid may be made of any material as long as it can be discharged from the droplet discharge device. For example, the material may be any one as long as it is in a liquid phase including liquid materials with high or low viscosity and fluid materials such as sol, gel water, other inorganic solvents, organic solvents, solutions, liquid resins, and liquid metals (metallic melts). Furthermore, the liquid encompasses not only liquid as one state of a material, but also solvents in which particles of a functional material which is a solid such as pigments or metal particles are dissolved, dispersed or mixed. Representative examples of the liquid include ink as described in the above embodiments and liquid crystals. The "ink" as used herein encompasses various kinds of liquid compositions such as general water-based ink and oil-based ink, gel ink, and hot-melt ink. Specific examples of the droplet discharge device include a droplet discharge device that discharges, in the form of droplets, liquid in which a material such as an electrode material or a color material used, for example, for production of liquid crystal displays, EL (electroluminescence) displays, surface light-emission displays, and color filters is dispersed or dissolved. Alternatively, the droplet discharge device may be a droplet discharge device that discharges a bioorganic substance used for production of biochips, a droplet discharge device that is used as a precision pipette and discharges liquid used as a sample, or the like. Alternatively, the droplet discharge device may be a droplet discharge device that discharges a lubricant to a desired point of a precision machine such as a watch or a camera or may be a droplet discharge device that discharges liquid of a transparent resin such as an ultraviolet curable resin onto a substrate for the purpose of formation of a minute hemispherical lens (optical lens) for use in an optical communication device or the like. Alternatively, the droplet discharge device may be a droplet discharge device that discharges etching liquid such as acid etching liquid or alkali etching liquid in order to perform etching on a substrate or the like.

The entire disclosure of Japanese Patent Application No. 2013-221645, filed Oct. 24, 2013 is expressly incorporated by reference herein.

What is claimed is:

1. A droplet discharge device comprising:

a discharging section having a discharge opening that is capable of discharging liquid in the form of droplets;

a supporting member that is capable of supporting a medium onto which the droplets discharged from the discharge opening adhere;

a gap adjusting section that is capable of adjusting a print gap between the discharging section and the supporting member; and a control section that is capable of executing a first process for forming an image on the medium by discharging droplets from the discharging section on the basis of image data and a second process for forming, on the medium, a test pattern for determination of a shift in droplet adhesion position by discharging droplets on the basis of test data, the control section executing the second process in a state in which the print gap is longer than the shortest print gap adjustable by the gap adjusting section, wherein the control section causes a speed of discharge of the droplets from the discharge opening in the second process to be lower than that in the first process.

2. The droplet discharge device according to claim 1, wherein the control section executes the second process in a state in which the print gap is longer than that in the first process.

3. The droplet discharge device according to claim 1, wherein the gap adjusting section adjusts the print gap by moving the discharging section in a direction away from the supporting member.

4. A droplet discharge device comprising:

a discharging section having a discharge opening that is capable of discharging liquid in the form of droplets;

a supporting member that is capable of supporting a medium onto which the droplets discharged from the discharge opening adhere;

a gap adjusting section that is capable of adjusting a print gap between the discharging section and the supporting member; and a control section that is capable of executing a first process for forming an image on the medium by discharging droplets from the discharging section on the basis of image data and a second process for forming, on the medium, a test pattern for determination of a shift in droplet adhesion position by discharging droplets on the basis of test data, the control section executing the second process in a state in which the print gap is longer than the shortest print gap adjustable by the gap adjusting section, wherein the control section causes the medium and the discharging section to move relative to each other in the first process and the second process; and wherein the control section causes a speed of the relative movement between the medium and the discharging section in the second process to be higher than that in the first process.

5. A droplet discharge method executed in a droplet discharge device that includes a discharging section having a discharge opening that is capable of discharging liquid in the form of droplets and a supporting member that is capable of supporting a medium onto which the droplets discharged from the discharge opening adhere, a print gap between the discharging section and the supporting member being adjustable, the droplet discharge method comprising:

executing a first process for forming an image on the medium by discharging droplets from the discharging section on the basis of image data; and executing a second process for forming, on the medium, a test pattern for determination of a shift in droplet adhesion position by discharging droplets on the basis of test data, the second process being executed in a state in which the print gap is longer than the shortest adjustable print gap, wherein a speed of discharge of the droplets from the discharge opening in the second process is lower than that in the first process.

* * * * *